US010821315B2

(12) United States Patent
Tsai et al.

(10) Patent No.: US 10,821,315 B2
(45) Date of Patent: Nov. 3, 2020

(54) MAGNETRON MECHANISM OF UNPOWERED TREADMILL

(71) Applicant: Advantek Health Tech Co., Ltd., Taichung (TW)

(72) Inventors: Tsung-Hsien Tsai, Taichung (TW); Yung-I Chang, Taichung (TW)

(73) Assignee: Advantek Health Tech Co., Ltd., Taichung (TW)

( * ) Notice: Subject to any disclaimer, the term of this patent is extended or adjusted under 35 U.S.C. 154(b) by 0 days.

(21) Appl. No.: 16/430,550

(22) Filed: Jun. 4, 2019

(65) Prior Publication Data

US 2019/0381348 A1 Dec. 19, 2019

(30) Foreign Application Priority Data

Jun. 15, 2018 (TW) ..... 107208090

(51) Int. Cl.

| | |
|---|---|
| ***A63B 21/005*** | (2006.01) |
| ***A63B 21/00*** | (2006.01) |
| ***A63B 21/22*** | (2006.01) |
| ***A63B 22/02*** | (2006.01) |
| ***A63B 21/04*** | (2006.01) |
| ***A63B 21/045*** | (2006.01) |

(52) U.S. Cl.

CPC ..... *A63B 21/0052* (2013.01); *A63B 21/045* (2013.01); *A63B 21/0435* (2013.01); *A63B 21/151* (2013.01); *A63B 21/157* (2013.01); *A63B 21/225* (2013.01); *A63B 22/02* (2013.01)

(58) Field of Classification Search

CPC . A63B 21/0052; A63B 21/151; A63B 21/225; A63B 22/02; A63B 21/0435; A63B 21/045; A63B 21/157; A63B 2071/0081; A63B 71/0054; A63B 1/00

See application file for complete search history.

(56) References Cited

U.S. PATENT DOCUMENTS 3,953,025 A * 4/1976 Mazman ..... A63B 21/015 482/118
4,007,927 A * 2/1977 Proctor ..... A63B 21/015 482/63
4,364,557 A * 12/1982 Serati ..... A63B 71/06 482/65
4,408,613 A * 10/1983 Relyea ..... A61B 5/222 482/5

(Continued)

*Primary Examiner* — Garrett K Atkinson

(74) *Attorney, Agent, or Firm* — Alan D. Kamrath; Mayer & Williams PC

(57) ABSTRACT

A magnetron mechanism of an unpowered treadmill contains: a driving body, a one-way transmission element, and a magnetron mechanism. The driving body includes a frame, a connection fence, a front wheel assembly, and a connection shaft. The one-way transmission element is mounted on the connection fence of the frame. The magnetron mechanism is fixed on the connection fence and includes a rotary shaft, a drive wheel, a driven wheel, a belt, a flywheel, a resistance element, and an adjustment unit. The resistance element has a pair of fixing sheets and multiple magnetic parts. Each of the multiple magnetic parts has a rotatable connection portion. The adjustment unit has a steel cable, an end of which is connected with the resistance element so that the steel cable pulls the resistance element to swing along the rotatable connection portion.

5 Claims, 7 Drawing Sheets

(56) References Cited

U.S. PATENT DOCUMENTS 4,417,724 A * 11/1983 Bikker ..... A63B 21/015 188/251 A
4,595,198 A * 6/1986 Sparks ..... A63B 21/015 188/184
4,673,177 A * 6/1987 Szymski ..... A63B 21/015 482/119
5,031,901 A * 7/1991 Saarinen ..... A63B 21/0051 310/191
5,466,203 A * 11/1995 Chen ..... A63B 21/0051 482/63
5,476,430 A * 12/1995 Lee ..... A63B 22/02 482/3
5,916,067 A * 6/1999 Morasse ..... A63B 69/16 482/61
6,491,606 B1 * 12/2002 Swift ..... A63B 22/0605 482/57
6,659,486 B2 * 12/2003 Eschenbach ..... B62K 3/002 280/221
7,172,532 B2 * 2/2007 Baker ..... A63B 22/0605 403/109.1
7,314,434 B2 * 1/2008 Chen ..... A63B 21/0051 188/164
7,364,533 B2 * 4/2008 Baker ..... A63B 22/0605 248/408
7,470,220 B2 * 12/2008 Hernandez ..... A63B 21/012 188/25
7,985,164 B2 * 7/2011 Ashby ..... G16H 20/30 482/8
8,585,561 B2 * 11/2013 Watt ..... A63B 22/0605 482/57
8,740,750 B2 * 6/2014 Jerichow ..... A63B 24/00 482/4
8,834,324 B2 * 9/2014 Lull ..... A63B 21/00069 482/63
9,044,635 B2 * 6/2015 Lull ..... A63B 22/0605
9,327,162 B2 * 5/2016 Huang ..... A63B 21/0051
9,839,807 B2 * 12/2017 Golesh ..... A63B 21/0051
9,987,516 B1 * 6/2018 Chen ..... A63B 21/4035
10,166,424 B2 * 1/2019 Chang ..... A63B 22/0605
10,207,143 B2 * 2/2019 Dalebout ..... A63B 21/154
2007/0265138 A1 * 11/2007 Ashby ..... H04L 67/04 482/8
2008/0234112 A1 * 9/2008 Hernandez ..... A63B 21/00069 482/63
2010/0069205 A1 * 3/2010 Lee ..... A63B 21/0051 482/63
2010/0081542 A1 * 4/2010 Ko ..... A63B 22/02 477/29
2010/0160115 A1 * 6/2010 Morris ..... A63B 22/0235 482/4
2010/0234185 A1 * 9/2010 Watt ..... A63B 21/0051 482/8
2010/0323850 A1 * 12/2010 Bingham, Jr. ..... A63B 22/0605 482/63
2011/0018527 A1 * 1/2011 Ko ..... G01D 5/145 324/207.25
2011/0105281 A1 * 5/2011 Jerichow ..... A61B 5/0833 482/54
2012/0088637 A1 * 4/2012 Lull ..... A63B 21/015 482/57
2012/0088638 A1 * 4/2012 Lull ..... A63B 21/225 482/57
2016/0263417 A1 * 9/2016 Golesh ..... A63B 21/00069
2017/0274237 A1 * 9/2017 Chang ..... A63B 21/00069
2018/0140896 A1 * 5/2018 Chen ..... A63B 22/02
2018/0200566 A1 * 7/2018 Weston ..... A63B 71/0622
2019/0168097 A1 * 6/2019 Lo ..... A63B 24/0087
2020/0030659 A1 * 1/2020 Xing ..... A63B 23/04

* cited by examiner

MAGNETRON MECHANISM OF UNPOWERED TREADMILL

BACKGROUND OF THE INVENTION

Field of the Invention

The present invention relates to a treadmill, and more particularly to a magnetron mechanism of unpowered treadmill.

Description of the Prior Art

With the development of science and technology, the quality of material life of people is enhanced. In addition to meeting the basic needs of life, more and more attention is paid to sports so as to bring health and healthy figure. However, most people are very busy because of their normal life. When they are on vacation or have time to exercise, they are unable to go smoothly due to the venue and other factors. To overcome this problem, people exercise by ways of a treadmill. The treadmill contains a hand support, a frame, and a treadmill running belt, wherein the hand support is mounted on a front end of the frame, the frame has a front wheel assembly and a rear wheel assembly which are arranged on a front end and a rear end of the frame, the treadmill running belt is winded between the front wheel assembly and the rear wheel assembly of the frame respectively, such that the user runs on the treadmill running belt, thus achieving using convenience and easy exercise.

The treadmill contains an electric treadmill and an unpowered treadmill which is not driven by power so as to save energy efficiency. To make the user running on the unpowered treadmill in different resistances based on using requirements, the unpowered treadmill contain a magnetron mechanism fixed on a side of the front wheel assembly, and the magnetron mechanism includes a flywheel and a magnetic part which is adjustable to different positions. When the magnetron mechanism operates, the magnetic part moves relative to the flywheel so as to adjust a rotation resistance of the flywheel, thus adjusting running resistance when the user runs on the unpowered treadmill. To avoid the user falling from the treadmill running belt after the user stops running and the treadmill running belt slides continuously because of inertia, a one-way transmission device is defined between the magnetron mechanism and the front wheel assembly, hence the treadmill running belt stops immediately to enhance using safety.

However, the magnetron mechanism and the one-way transmission device are complicated to cause high fabrication cost and are assembled, removed, and maintained troublesome, thus increasing labor consumption and assembling time.

The present invention has arisen to mitigate and/or obviate the afore-described disadvantages.

SUMMARY OF THE INVENTION

The primary objective of the present invention is to provide a magnetron mechanism of an unpowered treadmill which is simplified to reduce fabrication cost, and the magnetron mechanism and the one-way transmission element are assembled, removed, and maintained easily and quickly, thus saving labor consumption and assembling time.

To obtain above-mentioned objective, a magnetron mechanism of an unpowered treadmill provided by the present invention contains: a driving body, a one-way transmission element, and a magnetron mechanism.

The driving body includes a frame, a connection fence formed on a peripheral side of the frame, a front wheel assembly fixed on a front end of the frame, and a connection shaft fixed on the front wheel assembly and extending to the connection fence.

The one-way transmission element is mounted on the connection fence of the frame.

The magnetron mechanism is fixed on the connection fence of the frame. The magnetron mechanism includes a rotary shaft, a drive wheel, a driven wheel, a belt, a flywheel, a resistance element, and an adjustment unit. The rotary shaft is connected on the one-way transmission element, the driven wheel is fitted with the connection shaft of the front wheel assembly of the driving body, the driven wheel is fitted with the rotary shaft, and the belt is winded between the drive wheel and the driven wheel so as to drive the drive wheel and the driven wheel to rotate. The flywheel is fitted with the rotary shaft, and the resistance element has a pair of fixing sheets and multiple magnetic parts which are arranged parallelly. Each of the multiple magnetic parts has a rotatable connection portion formed on an end thereof so as to rotatably connect on the connection fence of the frame by mating with a resilient element, such that the pair of fixing sheets swings along the rotatable connection portion, and the resilient element pushes the pair of fixing sheets to move back to an original position automatically. Each pair of the multiple magnetic parts are oppositely arranged on the pair of fixing sheets, the adjustment unit has a steel cable, an end of which is connected with the resistance element so that the steel cable pulls the resistance element to swing along the rotatable connection portion.

DETAILED DESCRIPTION OF THE PREFERRED EMBODIMENTS

Figure 1:
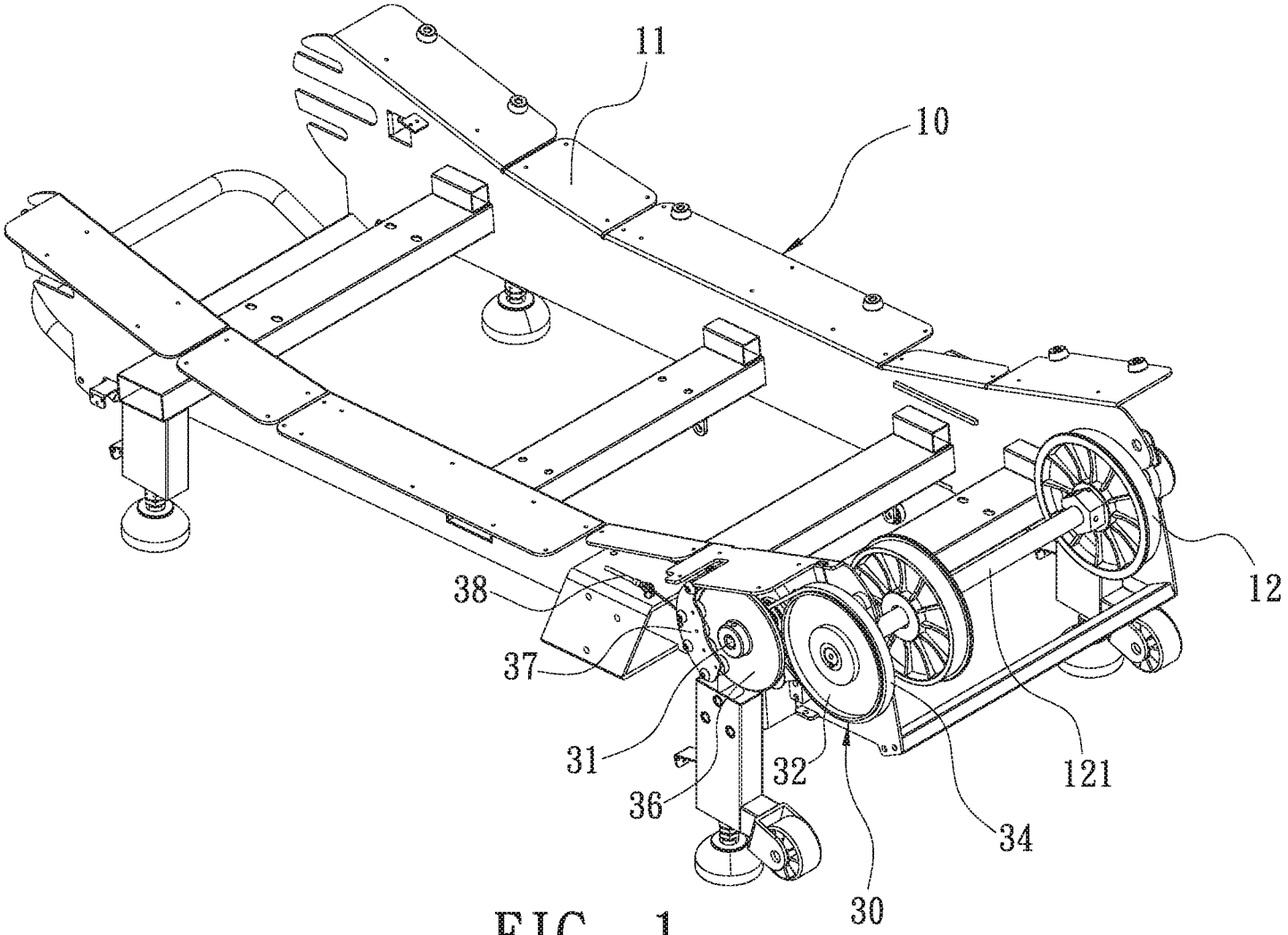
FIG. 1 is a perspective view showing the assembly of a magnetron mechanism of an unpowered treadmill according to a preferred embodiment of the present invention.
Figure 2:
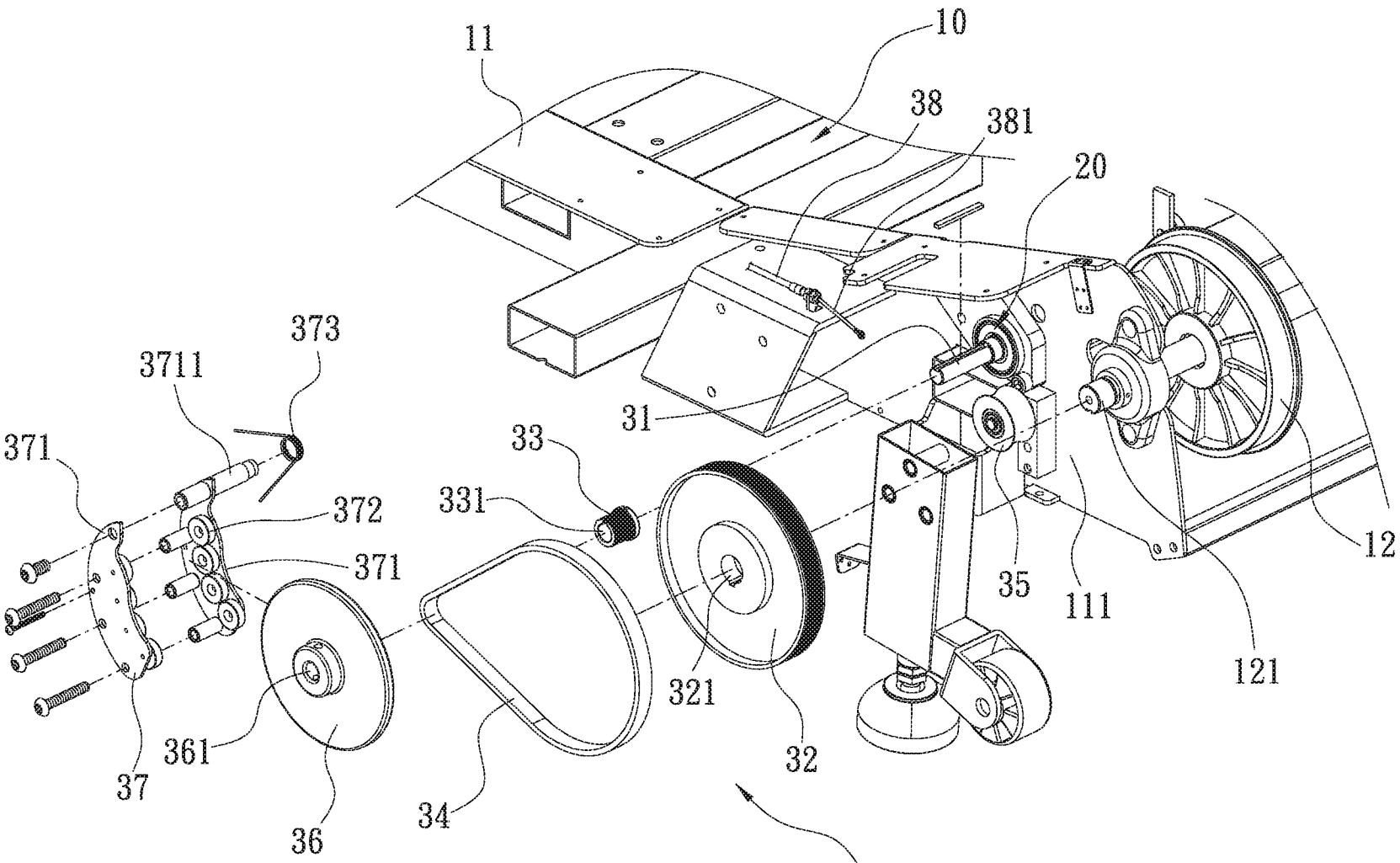
FIG. 2 is a perspective view showing the assembly of the magnetron mechanism of the unpowered treadmill according to the preferred embodiment of the present invention.
Figure 3:
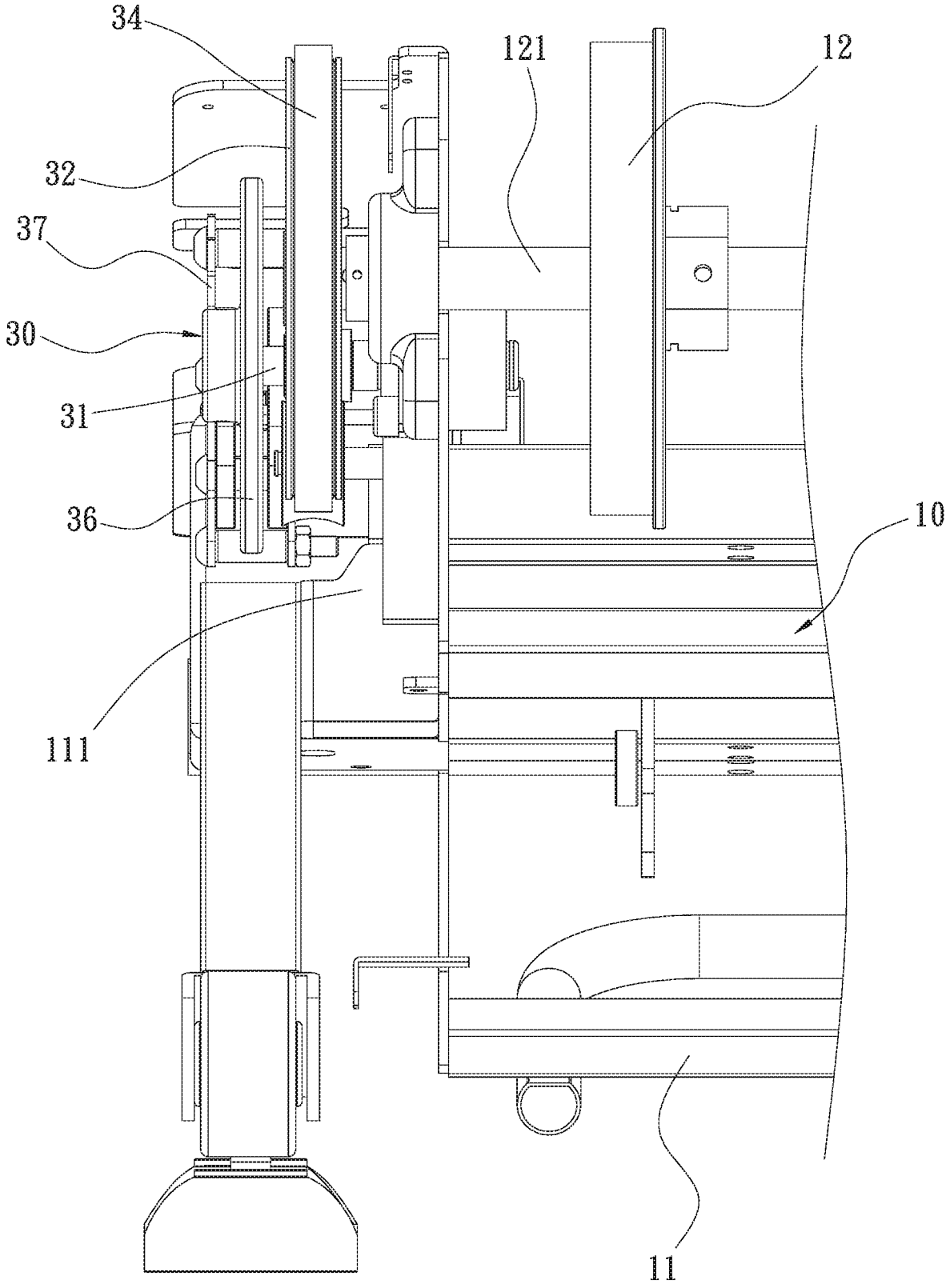
FIG. 3 is a side plan view showing the assembly of a part of the magnetron mechanism of the unpowered treadmill according to the preferred embodiment of the present invention.
Figure 4:
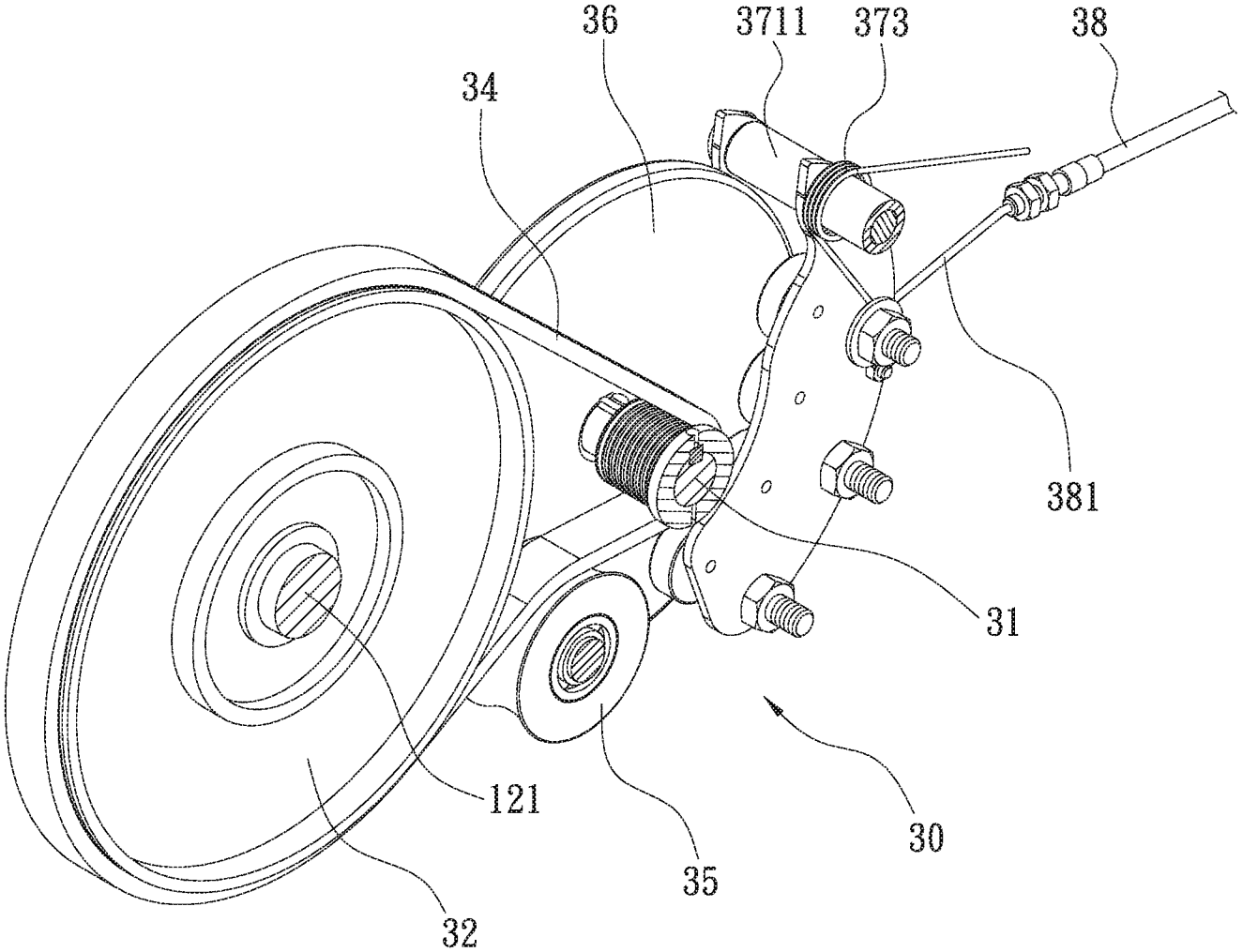
FIG. 4 is a perspective view showing the assembly of a part of the magnetron mechanism of the unpowered treadmill according to the preferred embodiment of the present invention.
Figure 5:
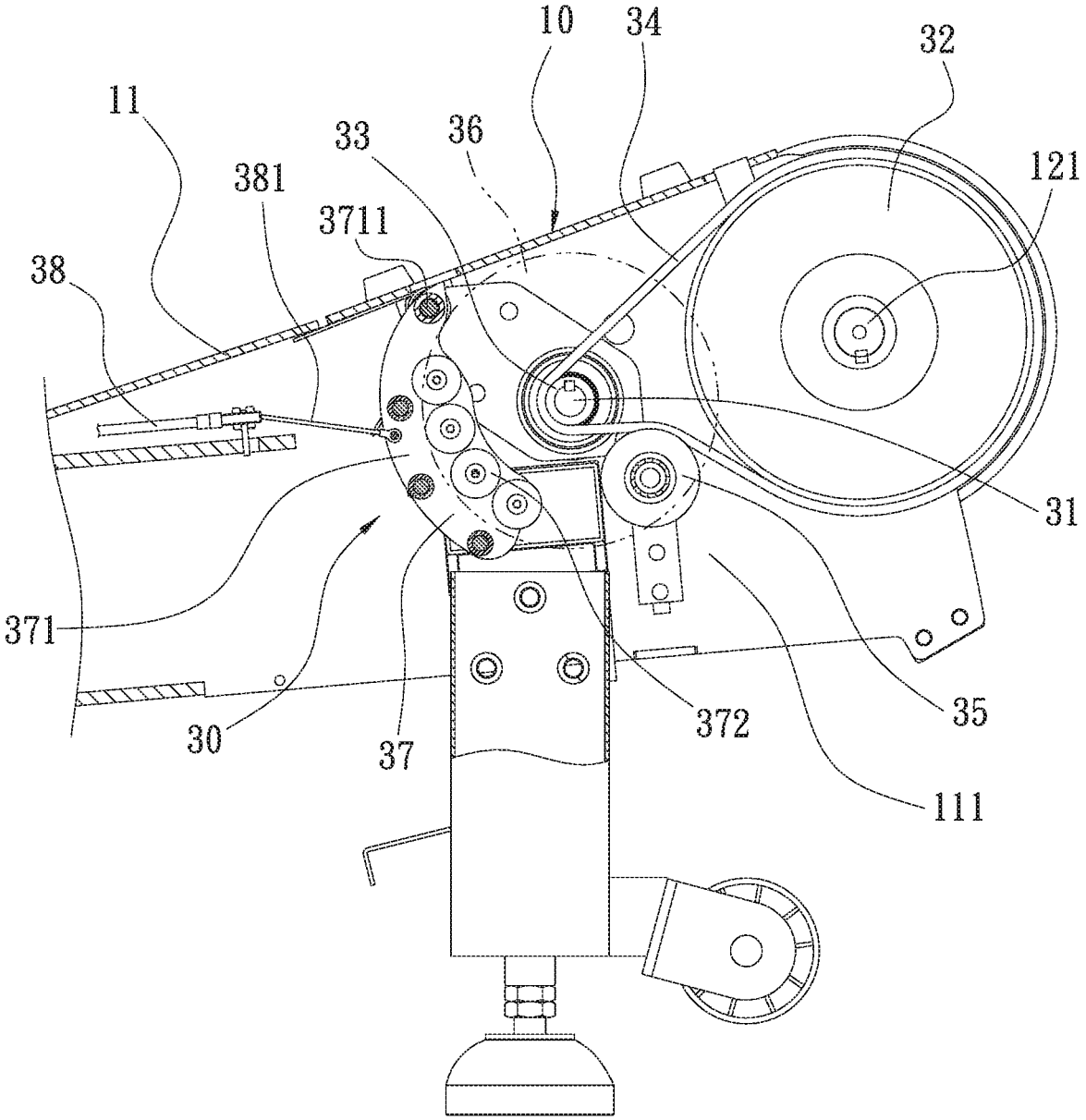
FIG. 5 is a cross sectional view showing the assembly of a part of the magnetron mechanism of the unpowered treadmill according to the preferred embodiment of the present invention.

The present invention will be clearer from the following description when viewed together with the accompanying drawings, which show, for purpose of illustrations only, a preferred embodiment in accordance with the present invention.

With reference to FIGS. 1-5, a magnetron mechanism of an unpowered treadmill according to a preferred embodiment of the present invention comprises: a driving body 10, a one-way transmission element 20, and a magnetron mechanism 30.

The driving body 10 includes a frame 11, a hand support (not shown) connected with a front portion of the frame 11, a connection fence 111 formed on a peripheral side of the frame 11, a front wheel assembly 12 and a rear wheel assembly (not shown) which are fixed on a front end and a rear end of the frame 12 respectively, a treadmill running belt (not shown) winded between the front wheel assembly 12 and the rear wheel assembly (not shown), a connection shaft 121 fixed on the front wheel assembly 12 and extending to the connection fence 111.

The one-way transmission element 20 is mounted on the connection fence 111 of the frame 11 of the driving body 10, and the one-way transmission element 20 is a one-way bearing.

The magnetron mechanism 30 is fixed on the connection fence 111 of the frame 11, and the magnetron mechanism 30 includes a rotary shaft 31, a drive wheel 32, a driven wheel 33, a belt 34, a press wheel 35, a flywheel 36, a resistance element 37, and an adjustment unit 38. The rotary shaft 31 is connected on the one-way transmission element 20, the driven wheel 32 has a first orifice 321 defined on a center thereof so as to fit with the connection shaft 121 of the front wheel assembly 12 of the driving body 10. The driven wheel 33 has a second orifice 331 defined on a center thereof so as to fit with the rotary shaft 31. The belt 34 is a timing belt winded between the drive wheel 32 and the driven wheel 33 so as to drive the drive wheel 32 and the driven wheel 33 to rotate. The press wheel 35 is arranged on an end of the rotary shaft 31 so as to press the belt 34, thus obtaining tightness of the belt 34.

The flywheel 36 is made of aluminum alloy and is circular, and the flywheel 36 includes a third orifice 361 defined on a center thereof so as to fit with the rotary shaft 31. The resistance element 37 has a pair of fixing sheets 371 and multiple magnetic parts 372 which are arranged parallelly, wherein each of the multiple magnetic parts 372 has a rotatable connection portion 3711 formed on an end thereof so as to rotatably connect on the connection fence 111 of the frame 11 by mating with a resilient element 373, such that the pair of fixing sheets 371 swing along the rotatable connection portion 3711, and the resilient element 373 pushes the pair of fixing sheets 371 to move back to an original position automatically. Each pair of the multiple magnetic parts 372 are oppositely arranged on the pair of fixing sheets 371. In this embodiment, each of the multiple magnetic parts 372 is a magnet, and the resilient element 373 is a torsion spring. The adjustment unit 38 has a steel cable 381, an end of which is connected with the pair of fixing sheets 371 of the resistance element 37 so that the steel cable 381 pulls the pair of fixing sheets 371 of the resistance element 37 to swing along the rotatable connection portion 3711.

Figure 6:
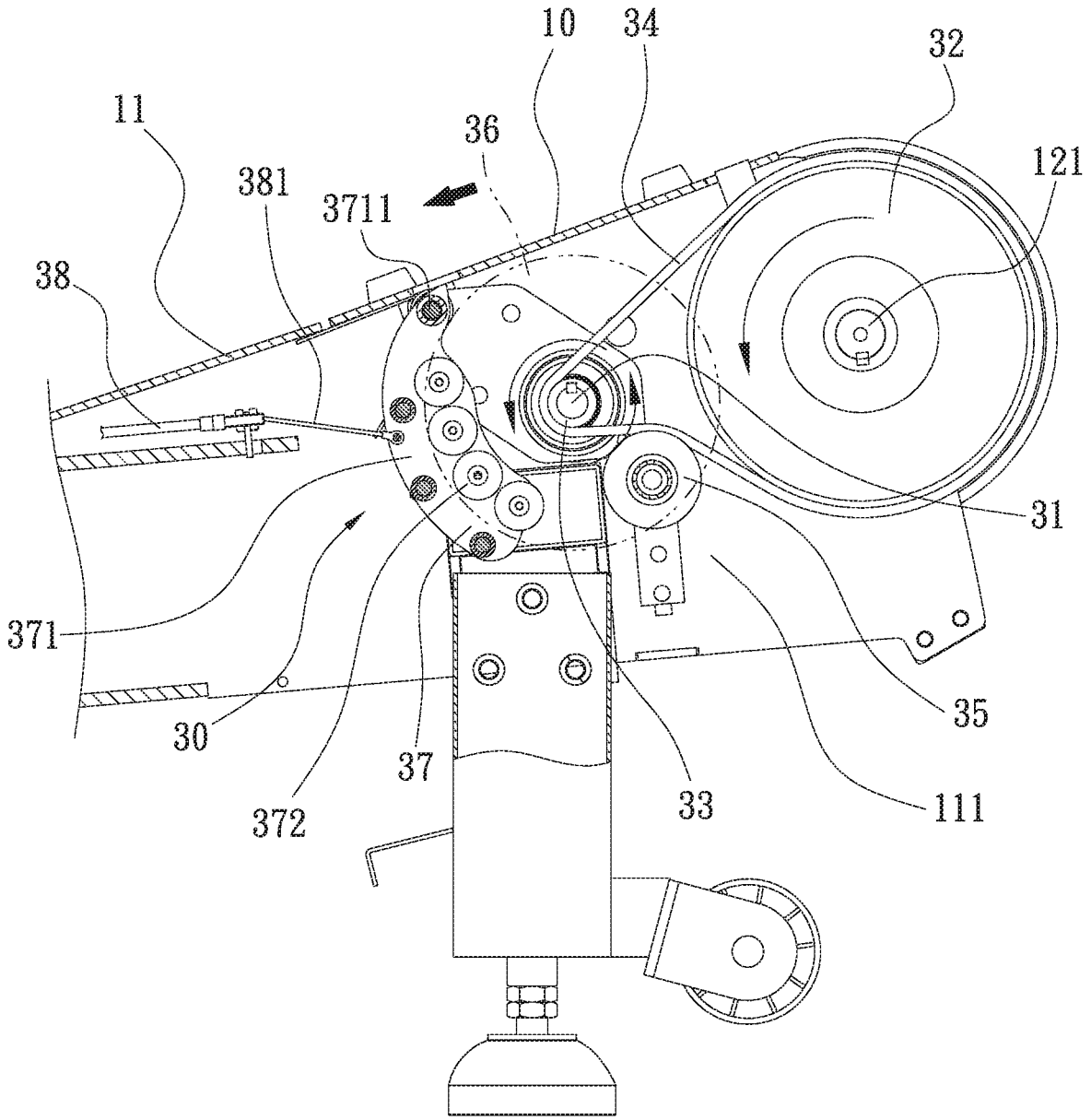
FIG. 6 is a cross sectional view showing the operation of the magnetron mechanism of the unpowered treadmill according to the preferred embodiment of the present invention.
Figure 7:
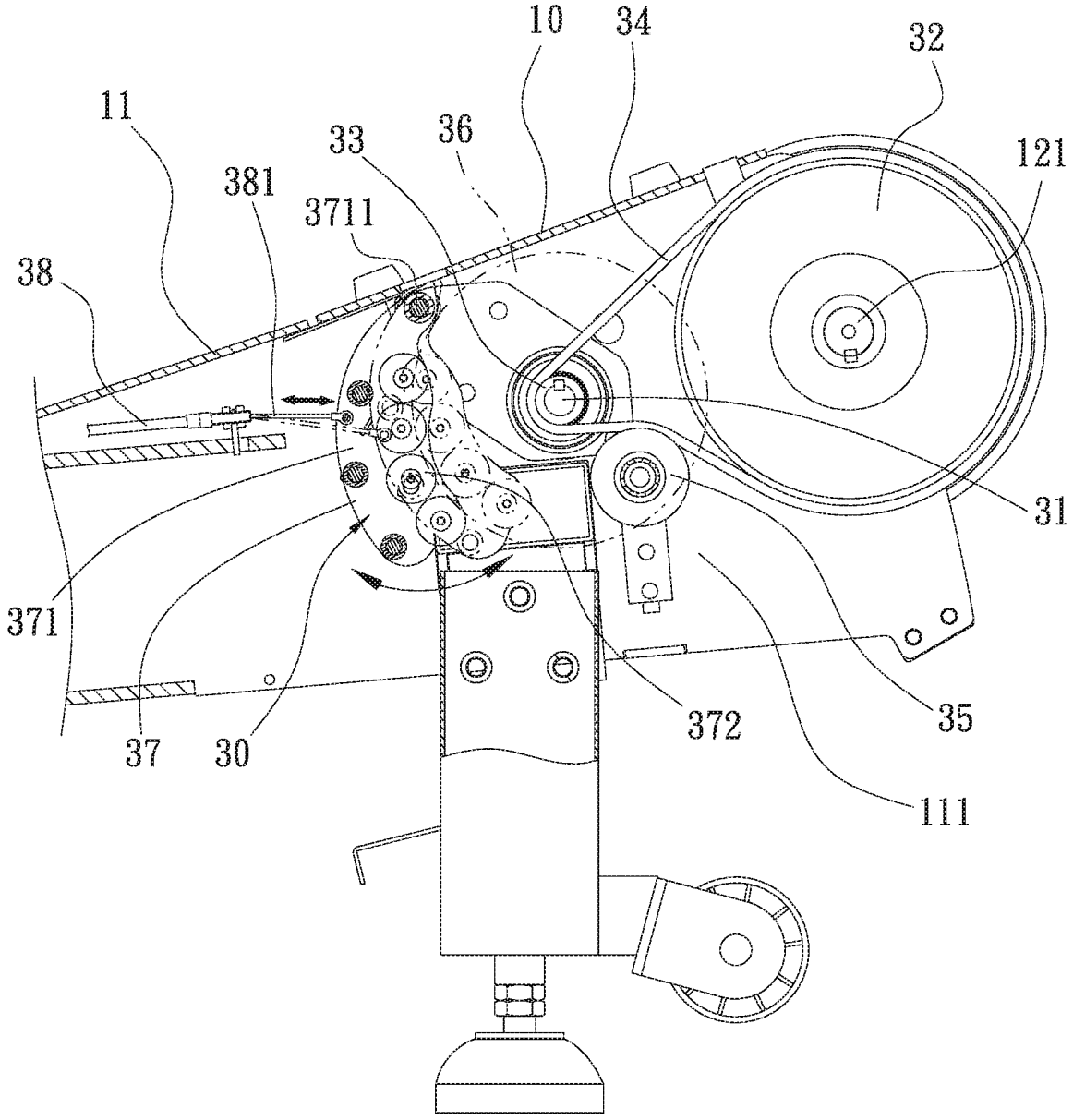
FIG. 7 is another cross sectional view showing the operation of the magnetron mechanism of the unpowered treadmill according to the preferred embodiment of the present invention.

As shown in FIGS. 6 and 7, after a user runs on the belt, the front wheel assembly 12 and the rear wheel assembly rotate to actuate the drive wheel 32 of the magnetron mechanism 30 to rotate with the connection shaft 121 of the front wheel assembly 12, the drive wheel 32 drives the driven wheel 32 to revolve via the belt 34, and the driven wheel 33 actuates the flywheel 36 to rotate via the rotary shaft 31, wherein the multiple magnetic parts 372 of the resistance element 37 and the flywheel 36 produce eddy currents by which resistance generates, the steel cable 381 of the adjustment unit 38 pulls the pair of fixing sheets 371 of the resistance element 37 of the resistance element 37 to swing along the rotatable connection portion 3711, and the resilient element 373 pushes the pair of fixing sheets 371 to move back to the original position automatically, thus adjusting the resistance. For example, the closer the magnetic member 372 of the resistance member 37 is to the flywheel 36, the greater the resistance generates. The farther the magnetic member 372 of the resistance member 37 is from the flywheel 36, the smaller the resistance generates, thus adjusting the resistance of the unpowered treadmill.

The rotary shaft 31 of the magnetron mechanism 30 is connected on the one-way transmission element 20, so when the user stops running on the unpowered treadmill, the unpowered treadmill is stopped immediately by using the one-way transmission element 20 without leaving inertia force, thus preventing the user falling from the unpowered treadmill and enhancing using safety.

The magnetron mechanism of the unpowered treadmill has following advantages:

The magnetron mechanism is simplified to reduce fabrication cost, and the magnetron mechanism 30 and the one-way transmission element 20 are assembled, removed, and maintained easily and quickly, thus saving labor consumption and assembling time.

While various embodiments in accordance with the present invention have been shown and described, it is clear to those skilled in the art that further embodiments may be made without departing from the scope of the present invention.

What is claimed is:

1. A magnetron mechanism of an unpowered treadmill comprising:

a driving body including a frame, a connection fence formed on a peripheral side of the frame, a front wheel assembly fixed on a front end of the frame, and a connection shaft fixed on the front wheel assembly and extending to the connection fence;

a one-way transmission element mounted on the connection fence of the frame; and a magnetron mechanism fixed on the connection fence of the frame, wherein the magnetron mechanism includes a rotary shaft, a drive wheel, a driven wheel, a belt, a flywheel, a resistance element, and an adjustment unit, the rotary shaft is connected on the one-way transmission element, the driven wheel is fitted with the connection shaft of the front wheel assembly of the driving body, the driven wheel is fitted with the rotary shaft, the belt is winded between the drive wheel and the driven wheel so as to drive the drive wheel and the driven wheel to rotate, wherein the flywheel is fitted with the rotary shaft, the resistance element has a pair of fixing sheets and multiple magnetic parts which are arranged parallelly, wherein each of the multiple magnetic parts has a rotatable connection portion formed on an end thereof so as to rotatably connect on the connection fence of the frame by mating with a resilient element, such that the pair of fixing sheets swings along the rotatable connection portion, and the resilient element pushes the pair of fixing sheets to move back to an original position automatically, wherein each pair of the multiple magnetic parts are oppositely arranged on the pair of fixing sheets, the adjustment unit has a steel cable, an end of which is connected with the resistance element so that the steel cable pulls the resistance element to swing along the rotatable connection portion.

2. The magnetron mechanism as claimed in claim 1, wherein the one-way transmission element is a one-way bearing.

3. The magnetron mechanism as claimed in claim 1 further comprising a press wheel arranged on an end of the rotary shaft so as to press the belt, thus obtaining tightness of the belt.

4. The magnetron mechanism as claimed in claim 1, wherein each of the multiple magnetic parts is a magnet.

5. The magnetron mechanism as claimed in claim 1, wherein the resilient element is a torsion spring.

* * * * *